US009449775B2

(12) United States Patent
Carrillo Soto et al.

(10) Patent No.: US 9,449,775 B2
(45) Date of Patent: Sep. 20, 2016

(54) THERMAL TRIP DEVICE, SWITCHING DEVICE, THERMAL MAGNETIC CIRCUIT BREAKER AND METHOD FOR PROTECTING AN ELECTRICAL CIRCUIT FROM DAMAGE

(71) Applicant: Siemens Aktiengesellschaft, Munich (DE)

(72) Inventors: Adrian Carrillo Soto, Monterrey (MX); Luis Miguel Franco Caballero, Nuevo Leon (MX)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/552,635

(22) Filed: Nov. 25, 2014

(65) Prior Publication Data

US 2015/0228433 A1 Aug. 13, 2015

(30) Foreign Application Priority Data

Feb. 11, 2014 (EP) ..... 14154685

(51) Int. Cl.

| | |
|---|---|
| ***H01H 81/00*** | (2006.01) |
| ***H01H 71/16*** | (2006.01) |
| ***H01H 71/40*** | (2006.01) |
| *H01H 5/18* | (2006.01) |

(52) U.S. Cl.
CPC ..... *H01H 71/16* (2013.01); *H01H 71/40* (2013.01); *H01H 5/18* (2013.01)

(58) Field of Classification Search
CPC ..... H01H 71/16; H01H 71/40; H01H 71/505
USPC ..... 335/35, 43, 146, 172
See application file for complete search history.

(56) References Cited

U.S. PATENT DOCUMENTS

| | | | | |
|---|---|---|---|---|
| 2,669,626 | A | 2/1954 | Rowe | |
| 4,386,329 | A * | 5/1983 | Norden | 335/35 |
| 6,222,433 | B1 | 4/2001 | Castonguay | |
| 6,850,134 | B2 * | 2/2005 | Lias et al. | 335/172 |
| 2004/0150495 | A1 * | 8/2004 | Lias et al. | 335/2 |

* cited by examiner

*Primary Examiner* — Bernard Rojas
(74) *Attorney, Agent, or Firm* — Harness, Dickey & Pierce, P.L.C.

(57) ABSTRACT

A thermal trip device of a thermal magnet circuit breaker is disclosed for protecting an electrical circuit from damage by overload. A switching device including such a thermal trip device is also disclosed, for interrupting a current flow. Further, a thermal magnetic circuit breaker is disclosed for protecting an electrical circuit from damage caused by overload or short circuit, including at least such a switching device. Further, a method is disclosed, for protecting an electric circuit from damage by overload by way of a thermal trip device of a thermal magnet circuit breaker.

11 Claims, 3 Drawing Sheets

THERMAL TRIP DEVICE, SWITCHING DEVICE, THERMAL MAGNETIC CIRCUIT BREAKER AND METHOD FOR PROTECTING AN ELECTRICAL CIRCUIT FROM DAMAGE

PRIORITY STATEMENT

The present application hereby claims priority under 35 U.S.C. §119 to European patent application number EP 14154685.3 filed Feb. 11, 2014, the entire contents of which are hereby incorporated herein by reference.

FIELD

At least one embodiment of the present invention is generally directed to a thermal trip device of a thermal magnet circuit breaker, wherein the thermal trip device has at least a bimetal element and a snap action device. At least one embodiment of the present invention is also generally directed to a switching device for interrupting a current flow and having at least a current conductive element, a tripping device, a bimetal element and/or a snap action device. Furthermore, on the one hand, at least one embodiment of the present invention is generally directed to a thermal magnetic circuit breaker having a switching device like mentioned above and on the other hand to a method for protecting an electric circuit from damage by overload by way of a thermal trip device of a thermal magnet circuit breaker.

BACKGROUND

Essentially, it is known that a thermal magnetic circuit breaker is a manually or automatically operating electrical switch designed to protect an electrical circuit from damage caused by overload or short circuit, for example. Its basic function is the detection of a fault condition and the interruption of current flow. Therefore, the thermal magnetic circuit breaker has for example at least one magnetic trip device in order to prevent the electrical circuit or an electrical device from damage by short circuit and a thermal trip device in order to prevent the electric circuit or an electrical device, like a load, from damage by overload. A short circuit is an abnormal connection between two nodes of the electric circuit intended to be at different voltages. Moreover, especially in reference to a molded-case circuit breaker, a short-circuit is an abnormal connection between two separate phases, which are intended to be isolated or insulated from each other. This results in an excessive electric current, named an overcurrent limited only by the Thévenin equivalent resistance of the rest of the network and potentially causes circuit damage, overheating, fire or explosion. An overload is a less extreme condition but a longer-term over-current condition as a short circuit.

The thermal magnetic circuit breaker or breaker, respectively, has different settings or adjustments, respectively, as to where does the client wants the breaker to trip thermally. These settings go for example from 0.8 ln to 1 ln, wherein 0.8 ln means 80% of the nominal current rated on the breaker and 1 ln means 100% of the nominal current rated on the breaker. Therefore, in a 100 Amp breaker, 80% will be 80 Amp.

Basing on a lower thermal adjustment, less electrical current goes through a conductive element like a conductor and results on a lower temperature on a bimetal element of the thermal trip device. Thus, the temperature profile of the thermal trip device of the thermal magnetic circuit breaker or thermal magnetic trip unit (TMTU) presents low temperature behaviour on the lower thermal adjustment side, which is for example 80% In and therefore 80% of the nominal current, as mentioned above. Since the movement of the bimetal element is a result of the temperature, such a low temperature is not enough in order to reach deflection and force of the bimetal element of the thermal trip device, which are necessary to unlatch the breaker mechanism. Essentially, the bimetal element needs a temperature of circa 150° C. in order to reach a sufficient deflection and release a breaker mechanism after an overload fault in the thermal magnetic circuit breaker.

Therefore, the deflection of the bimetal element is not enough for doing contact to the breaker mechanism, when a temperature is reached low like for example circa 80° C. Therefore, a lower electrical current inducts a less temperature and therefore, a less deflection and/or force of the bimetal element, during a high electrical current inducts a higher temperature and as a consequence, a higher deflection and/or force of the bimetal element.

It is known that a tripping device like a tripping slide of the breaker mechanism or a latch mechanism, respectively, unlatched by the deflected bimetal element has a ramp feature that allow different distances of the bimetal element depending of the available temperature besides there is a calibration screw that makes precision. A calibrations screw needs a detailed time-consuming calibration of a customer or end user or an operator during the calibration process and therefore a detailed expertise about the field of application and so on.

SUMMARY

At least one embodiment of the present invention is directed to a thermal magnetic circuit breaker and especially a thermal trip device of a thermal magnetic circuit breaker and more especially a switching device and/or a method for protecting an electric circuit from damage by overload, by which in an easy and cost-effective manner a wider range of the adjustment current ratings than the actual setup from 80% to 100% is allowed.

A thermal trip device, a switching device, a thermal magnetic circuit breaker and a method for protecting an electric circuit from damage by overload by way of a thermal trip device of a thermal magnet circuit breaker are disclosed. Further features and details of the invention are subject of the sub claims and/or emerge from the description and the figures. Features and details discussed with respect to the thermal trip device can also be applied to the switching device, the thermal magnetic circuit breaker and/or the method for protecting an electric circuit from damage and vice versa.

The thermal trip device of a thermal magnet circuit breaker for protecting an electrical circuit from damage by overload, in at least one embodiment, includes at least a bimetal element in order to be arranged with its first end at a current conductive element for conducting electrical current and in order to be arranged with its second end next to a tripping device adapted for interrupting a current flow. Furthermore, according to an embodiment of the invention, the thermal trip device has a snap action device for force transmission from the bimetal element to the tripping device.

BRIEF DESCRIPTION OF THE DRAWINGS

Embodiments of a thermal trip device and of a magnetic trip device of a thermal magnetic circuit breaker and a switching device are explained in more detail with reference to the accompanying drawings. The drawings show schematically in.

Figure 1:
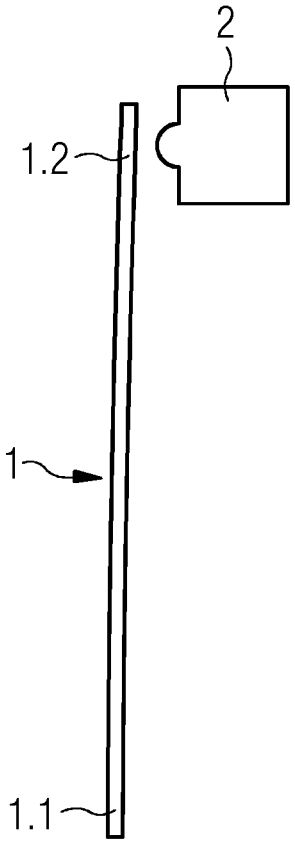
FIG. 1: a side view of a deflected bimetal element at a temperature of 80° C.

Elements having the same function and mode of action are provided in FIGS. 1 to 7 with the same reference signs.

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

In the following description, illustrative embodiments may be described with reference to acts and symbolic representations of operations (e.g., in the form of flowcharts) that may be implemented as program modules or functional processes include routines, programs, objects, components, data structures, etc., that perform particular tasks or implement particular abstract data types and may be implemented using existing hardware at existing network elements. Such existing hardware may include one or more Central Processing Units (CPUs), digital signal processors (DSPs), application-specific-integrated-circuits, field programmable gate arrays (FPGAs) computers or the like.

Note also that the software implemented aspects of the example embodiments may be typically encoded on some form of program storage medium or implemented over some type of transmission medium. The program storage medium (e.g., non-transitory storage medium) may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The example embodiments not limited by these aspects of any given implementation.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The thermal trip device of a thermal magnet circuit breaker for protecting an electrical circuit from damage by overload, in at least one embodiment, includes at least a bimetal element in order to be arranged with its first end at a current conductive element for conducting electrical current and in order to be arranged with its second end next to a tripping device adapted for interrupting a current flow. Furthermore, according to an embodiment of the invention, the thermal trip device has a snap action device for force transmission from the bimetal element to the tripping device.

Advantageously, the thermal trip device is a part of the thermal magnetic circuit breaker mentioned above and has at least a bimetal element, which is composed of at least two separate metals joined together. The bimetal element includes two layers of different metals, for example, wherein bimetal elements having three or four separate metals or layers, respectively, are referred to as trimetal or tetrametal. Therefore, the bimetal element of embodiments of the present inventions is also able to have three, four or more than four separate metals or layer, respectively.

The electrical current flowing through the conductive element emits heat, by which the bimetal element or trimetal element or tetrametal element, and so on, is heated, wherein due to this heat, a movement and especially a deflection of the bimetal element is triggered. That means, basing on the nature of the bimetal element, it converts the heat or temperature, respectively, into mechanical displacement generating certain amount of force. Thus, the amount of heat restricts the amount of force that will generate. Increasing the temperature generally of the current path and especially in the area of the conductive element of the thermal trip device results for example in overheating of lugs arranged at least nearly the conductive element above especial requirement specifications and therefore above for example a temperature of circa 50° C. Thus, an increasing of the temperature in order to optimize the movement of the bimetal element in order to interrupt the electrical current flow of the current circuit for protecting the circuit from overload and so on, leads to damage loads or comparable products. In the context of an embodiment of the present invention the electrical circuits includes also at least one load like an electrical device.

The bimetal element has a first end, also named lower end and a second end, also named upper end. Advantageously, the first end contacts at least partially a part of a current conductive element, which is for example a current conductive line, wherein the second end extends next to a tripping device or tripping slide, respectively, arranged to interact with the breaker mechanism or latch mechanism, respectively, in order to interrupt a current flow. The current conductive element is a part of the current path and able to conduct electrical current from an energy source to a load. Heat or thermal radiation, respectively, emitted by the electrical current flowing through the current conductive element migrates from the current conductive element via the first end of the bimetal element to the bimetal element in such a way that the bimetal element is heated at least indirectly. The heat causes the bimetal element to deflect, wherein the bimetal element moves in direction to the tripping device in order to contact and to unlatch the tripping slide. If the deflection is insufficient, because of a low reached temperature like mentioned above, the second end of the bimetal element is not able to contact or to unlatch the tripping device.

In order to overcome these disadvantages, a snap action device is arranged between the bimetal element and the tripping device and especially between the second end of the bimetal element and a contact area of the tripping device. It is conceivable that the first end and/or second end of the bimetal element are areas of the bimetal element extending from the distal ends of the bimetal element in direction to its middle or centre, respectively. Thus, both, the first end and the second end can have a length of for example a half-length of the overall length or more or less of the bimetal element. By means of the snap action device, the breaker mechanism is unlatched at low temperature and therefore after a small deflection of the bimetal element.

It is conceivable that the snap action device has a spring element fixed with its ends at a housing element. The housing element is for example a single housing separated from the housing of the thermal magnet circuit breaker or a part of the housing of the thermal magnet circuit breaker. The housing can also be a case with at least two openings or a holding element only arranged to hold the spring element at least at its ends. The spring element is for example an elastic and deformable element like a compression spring, a coil spring or a torsion spring and so on.

Advantageously, the spring element is a flat spring preloaded in a curved manner. The flat spring is made of a flat or conical shaped piece of metal and has two ends fixed for example at a holding element like a housing. Basing on the preload, the flat spring has a curved or bent shape. It is conceivable that the ends of the flat spring have holding areas formed in such a way that the flat spring is arranged at or fixed with the holding element in an easy and safe manner.

Advantageously, in an initial position of the snap action device, the curve of the spring element is bended in direction to the bimetal element, and in a trip position of the snap action device, the curve of the spring element is bended in direction to the tripping device. The initial position is especially a position by which no deflection or at least a minimal deflection of the bimetal element occurs. An at least minimal deflection occurs due to a minimal heating of the bimetal element, when for example, the circuit is in normal condition and therefore no trip event like an overload occurs.

Therefore, a trip position is a position of the spring element, by which the bend or curve of the spring element extends in an opposite direction regarding to the bend or curved of the spring element situated in an initial position. That means that the bimetal element is deflected is such a way that especially one end of the bimetal element and in particularly the second end of the bimetal element contacted the spring element situated in an initial position and pushed the spring element out of the initial position. Thus, the force of the bimetal element basing on the deflection of the latter is transmit to the spring element and especially to the flat spring and further from the spring element to the tripping device.

Advantageously, the transmitted force is still increased by way of the spring element. That means that more force is applied from the spring element to the trip device as from of the bimetal element to the spring element. Therefore, on the one hand, the spring element is a force carrier and on the other hand, a force increase device. Thus, the spring element changes its shape for increasing the force applied to it.

It is also conceivable that the bimetal element has an actuator element arranged at the second end of the bimetal element in order to contact the spring element at least during an overload occurs. Advantageously, by way of the actuator element a defined contacting area of the spring element is adjustable. Thus, only a small force applied to the spring element by means of the deflected bimetal element is needed in order to move the spring element from an initial position to a trip position.

Furthermore, according to a second embodiment of the invention a switching device for interrupting a current flow is claimed. The switching device has at least a current conductive element for conducting electrical current, a tripping device adapted to interrupt the current flow, a bimetal element in order to be arranged with its first end at the current conductive element and in order to be arranged with its second end next to the tripping device and/or a snap action device arranged between the tripping device and the bimetal element in order to transmit force of the bimetal element to the tripping device at least during a trip event occurs. It is conceivable that the tripping device is arranged at a kicker element, which is able to hitch a mechanism trip bar for unlatching a breaker mechanism in order to interrupt a current flow or a current path, respectively. The kicker element and/or the mechanism trip bar can be components of the switching device.

Advantageously, the bimetal element of the switching device is heated indirectly due to the electrical current conducted through the current conductive element arranged at the first end of the bimetal element. Based on this heating up, the bimetal element is deflected or bent, respectively, in direction to the snap action device. When the bimetal element gets the temperature desired of the tripping 80° C., the bimetal element and especially the actuator of the bimetal element will contact the spring element and will hit the spring element with a minimum force. Afterwards, the spring element translates this force increased to the tripping device, which in turn trip the latch mechanism or breaker mechanism, respectively, of the thermal magnetic circuit breaker.

Advantageously, the switching device has a thermal trip device according to a first embodiment of the invention. That means that the switching device has a thermal trip device like mentioned above.

The switching device mentioned above also has all advantages mentioned above concerning the thermal trip device.

Furthermore, a thermal magnetic circuit breaker for protecting an electrical circuit from damage caused by overload or short circuit is claimed according to a third embodiment of the invention. The thermal magnetic circuit breaker has at least one switching device according to the second embodiment of the invention, and therefore a switching device like mentioned above according to the first embodiment of the invention. That means the thermal magnetic circuit breaker has a thermal trip device like mentioned above.

Advantageously, the thermal magnetic circuit breaker, also named thermal magnetic trip unit (TMTU), comprises a magnetic system and especially a translational magnetic trip device in order to interrupt a current flow during a trip event, as a short circuit occurs in order to prevent the circuit from damage. It is conceivable that a common adjustment system like an adjustment bar is arranged at the magnetic system in order to set single magnetic trip devices of the thermal magnetic circuit breaker, for example a three-pole arrangement instantaneously.

It is conceivable that the magnetic trip device of the thermal magnetic circuit breaker has an armature element reacting to a magnetic field resulting from current flowing through a solenoid element. Advantageously, the magnetic trip device has at least one armature element moveably arranged with respect to a yoke or especially to a current conductive element conducting electrical energy or current, respectively. The armature element or armature, respectively, is a magnetic element and especially a pole piece having at least partially an iron material and reacting to a magnetic field created by the yoke during a trip moment. In order to realize a guided movement of the armature element towards the yoke at least during a trip event like a short circuit, the armature element is arranged on an armature locator. The armature locator is moveable arranged on a pin extending from an adjustment bar towards the yoke, for example. The armature locator can be connected with a tripping slide, which is able to interrupt a current flow of the current circuit, when the tripping slide is moved due to a movement of the armature locator in conjunction with the armature element towards the yoke because of a magnetic force.

The thermal magnetic circuit breaker mentioned above also has all advantages mentioned above concerning the thermal trip device and/or the switching device.

Furthermore, a method for protecting an electric circuit from damage by overload by way of a thermal trip device of a thermal magnet circuit breaker is disclosed. The method has at least the following steps: an electric current conducted at least partially along a current conductive element heats a bimetal element arranged with its first end at the current conductive element at least indirectly during an overload occurs, wherein basing on the heating, the bimetal element deflects in direction to a tripping device, wherein a snap action device arranged between the bimetal element and the tripping device transmits a force of the deflecting bimetal element to the tripping device in order to move the tripping device for interrupting the current flow. It is conceivable that the bimetal element is arranged at a heater element arranged at the current conductive element, wherein the heater element is used to transmit heat or thermal energy, respectively to the bimetal element in order to heat the latter. The heater element can also be a part of the current conductive element or vice versa. Basing on the heating of the bimetal element, it deflects in such a way that especially its second end bends or moves, respectively, in direction to the snap action device having a spring element, advantageously.

If the bimetal element and especially its second end and more especially an actuator element extended in direction to the snap action device and arranged at the second end of the bimetal element contacts the spring element of the snap action device, the spring element changes its position and shape. That means that the curve of a spring element preloaded arranged at a holding element, for example a housing, changes its form. Thus, the curve bended in direction to the bimetal element before a contact between the spring element and the bimetal element took place, moves to the opposite in direction to the tripping device.

Therefore, after a contact between the spring element and the bimetal element, the curve of the spring element extends in direction to the tripping device and contacts the tripping device at least partially and/or at least temporally. The tripping device is unlatched by way of the spring element. Therefore, the spring element moved in the trip position pushes the tripping device in such a way that a holding mechanism of the tripping device is disengaged. Thus, the tripping device is able to rotate about its longitudinal axis by means of a further spring element like a torsion spring in order to unlatch a breaker mechanism or a kicker element, for example. Due to the unlatching of the breaker mechanism, the current flow is interrupted due to an interruption of the current path.

Therefore, it is conceivable that a spring element and especially a flat spring of the snap action device moves from an initial position to a trip position in order to unlatch the tripping device during occurrence of an overload.

In order to return the spring element from a trip position to an initial position, the tripping device hits the spring element in an area of the curve of the latter. Basing on this hitting, a force of the tripping device is transmitted to the spring element, but advantageously this force is not hit from the spring element to the bimetal element, because the bimetal element is removed in its normal shape and therefore in its straight shape.

Advantageously, a thermal trip device is used and has therefore a shape and/or function like mentioned above.

Embodiments of the method mentioned above also has all advantages mentioned above concerning the embodiments of the thermal trip device and/or the switching device and/or the thermal magnetic circuit breaker.

Advantageously, by way of embodiments of the present invention and especially by way of embodiments of the thermal trip device and/or switching device and/or thermal magnet circuit breaker, the adjustment ratings could do of 60% to 100%.

In FIG. 1 a side view of a bimetal element 1 is shown, wherein the bimetal element 1 has a first end 1.1 or lower end 1.1, respectively, and a second end 1.2 or upper end 1.2, respectively. The bimetal element 1 is heated at a temperature of 80° C., wherein only a small deflection of the bimetal element 1 is triggered. That means that the second end 1.2 of the bimetal element 1 is not able to contact a contact area of the tripping device 2 in order to unlatch the tripping device 2 for interrupting a current flow. The first end 1.1 is arrangeable at a not shown current conductive element or heater element in order to pick up heat produced by the electrical current flowing through the current conductive element.

Figure 2:
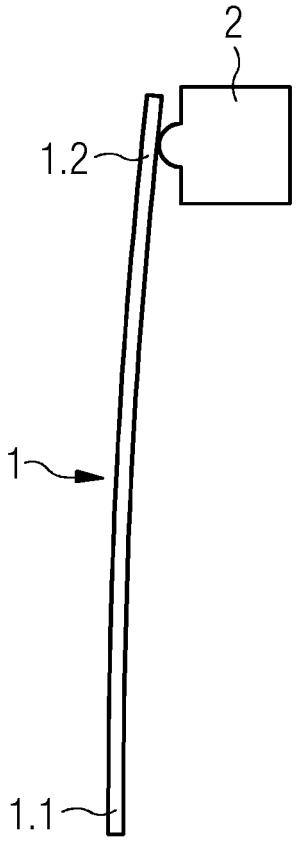
FIG. 2: a side view of a deflected bimetal element at a temperature of 150° C.

Like shown in FIG. 2, the second end 1.2 of the bimetal element 1 is able to contact the tripping device 2 in order to trigger a breaker mechanism at a temperature of 150° C. That means that a sufficient bending or deflection, respectively, of the bimetal element 1 is only guaranteed, when the bimetal element 1 is heated at a temperature of 150° C. and more. Therefore, functionality of the thermal trip device and especially of the thermal trip circuit breaker having a bimetal element 1 like shown in FIG. 1 or 2 is not guaranteed at an adjustment current rating of 80% or less. In FIGS. 1 and 2 the problem of using currently known thermal trip devices is shown.

Figure 3:
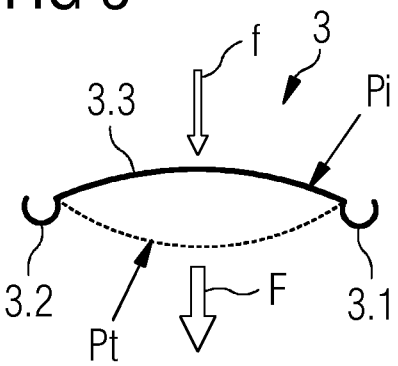
FIG. 3: a side view of an embodiment of a spring element of a snap action device.

In FIG. 3, a spring element 3 of a snap action device (shown for example in FIG. 4 to 6) is shown. Advantageously, the spring element 3 is a flat spring having a first holder end area 3.1 and a second holder end area 3.2 formed in order to interact with elements of a not shown holder housing. Therefore, it is conceivable that the end areas 3.1 and 3.2 of the spring element 3 each have a shape like a hook in order to engage with notches, noses, protrusions or comparable elements of the holder housing. A bended or curved spring winding 3.3 extending between the end areas 3.1 and 3.2 is positioned in an initial position Pi before a force f and especially a minimal force f is applied. If the minimal force f is applied to the spring element 3 and especially to the bended spring winding 3.3, the position of the spring winding 3.3 changes. The spring winding 3.3 flips or moves, respectively, to the trip position Pt shown with the dotted line. Basing on the movement of the spring winding 3.3, the applied minimal force f is increased to a higher or bigger force F. Therefore, the unlatching of a tripping device (here not shown) is done by means of a big force F. Thus, the unlatching of the tripping device and therefore the interrupting of a current flow during a trip even like an overload is safety done, also, when only a small force f is applied to the spring element 3 due to a minimal deflection of the bimetal element 1 shown in FIG. 1 or 2.

Figure 4:
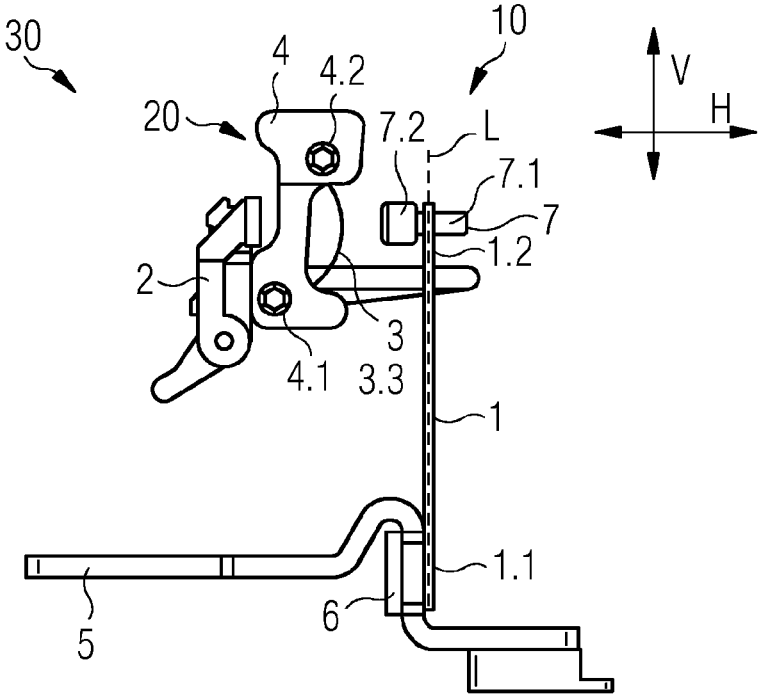
FIG. 4: a side view of an embodiment of a switching device with a snap action device situated in an initial position.
Figure 5:
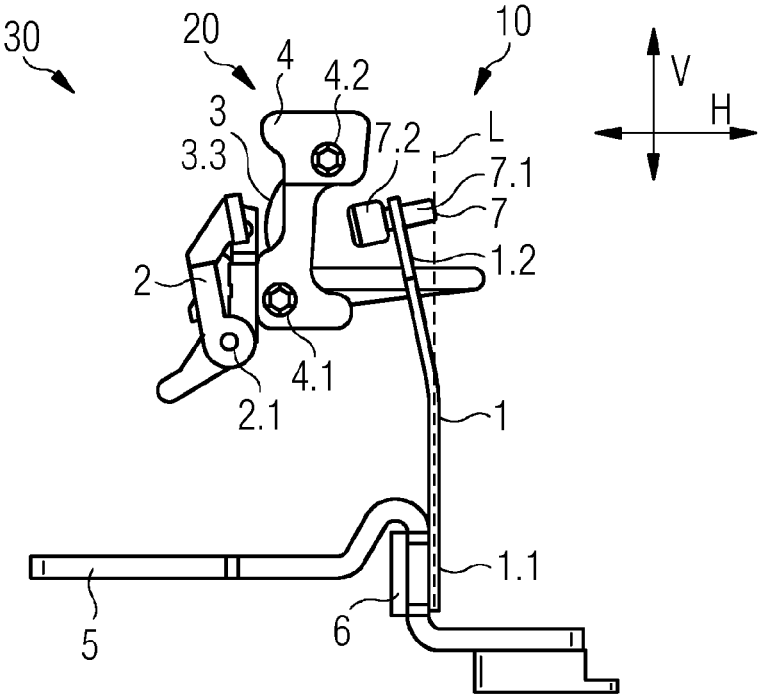
FIG. 5: a side view of the embodiment of a switching device shown in FIG. 4 with a snap action device situated in a trip position.
Figure 6:
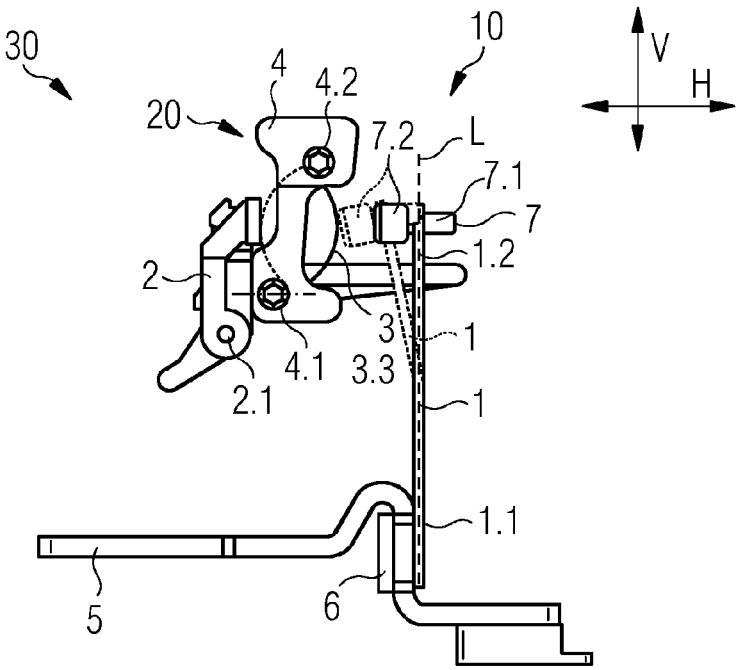
FIG. 6: a side view of a reset view of the embodiment of a switching device shown in FIGS. 4 and 5 with a snap action device reset from a trip position to an initial position.

In FIGS. 4, 5 and 6 side views of an embodiment of a switching device 30 are shown. Especially, FIG. 4 shows a snap action device 20 positioned in an initial position Pi (cf. FIG. 3), wherein the spring element 3 and essentially the spring winding 3.3 is bended in direction to the bimetal element 1. The bimetal element 1 is arranged with its first end 1.1 at a current conductive element 5 for conducting electrical current along a predefined current path. It is also conceivable that the bimetal element 1 is arranged with its first end 1.1 at a heater element 6 arranged at the current conductive element 5 in order to transmit heat to the bimetal element 1. At a second end 1.2, an actuator element 7 is arranged at the bimetal element 1. The actuator element 7 extends in horizontal direction H, for example, and has a fixing part 7.1 in order to fix the actuator element 7 to the bimetal element 1. A contacting part 7.2 is a second part of the actuator element 7 and enables the contact between the snap action device 20 and especially the spring element 3 of the snap action device 20 and the bimetal element 1. Advantageously, the thermal trip device 10 has at least the bimetal element 1 mentioned above and the snap action device 20 mentioned above.

Without heating the bimetal element 1, latter extends essentially in vertical direction V without bending and therefore without contacting the snap action device 20.

The snap action device 20 has for example on the one hand, the spring element 3 and on the other hand, a housing 4 in order to fix and preload the spring element 3. Thus, the housing 4 is a clamp device and for example a part of a housing or element of the terminal, namely the thermal magnetic circuit breaker. However, it is also conceivable that the housing 4 is a separate component. The housing 4 has at least two clamp elements, namely a fist clamp element 4.1 and a second clamp element 4.2 formed like holder elements in order to hold and preload the spring element 3. The clamp elements 4.1 and 4.2 are spaced to each other in vertical direction V and advantageously also in horizontal direction H. Between the clamp element 4.1 and 4.2 and especially between the areas holding the clamp elements 4.1, 4.2, an opening (not shown) is arranged. This opening or passage, respectively, enables a movement of the spring element 3 from one side of the housing 4 to an opposite side of the housing 4 and backwards and therefore a movement of the spring element 3 from an initial position to a trip position.

Opposite to the bimetal element 3, a tripping device 2 is arranged next to the snap action device 20. Therefore, the tripping device 2 is arranged next to one side, named also trip side, of the snap action device 20. The bimetal element 1 is arranged next to another side, named initial side, of the snap action device 20.

In FIG. 5, a movement and especially a deflection of the bimetal element 1 is shown. Due to this deflection, the actuator element 7 contacts the spring element 3 and especially the spring winding 3.3 of the spring element 3 with at least a minimal force f (cf. FIG. 3) in order to push the spring winding 3.3 in direction to the tripping device 2. Therefore, the spring winding 3.3 flips through the passage of the housing 4 of the snap action device 20. That means during a trip event, when an overload occurs, the bimetal element 1 deflects in direction to the snap action device 20 and is bended away from its longitudinal axis L, whereby a position of the spring element 3 is changed from an initial position like shown in FIG. 4 to a trip position like shown in FIG. 5. Thus, the curve of the spring device 3 extends in direction to the tripping device 2, wherein by the increasing force F induced by the movement of the spring winding 3.3, the tripping device 2 is unlatched and pivots around its pivot axis 2.1, advantageously additional by means of a not shown further spring element like a compression spring.

After the trip, the bimetal element 1 is getting cold, until the temperature stabilisation of the environment and therefore until 30° C. to 25° C. Therefore, the bimetal element 1 moves back in a straight position and extends in a longitudinal direction L finally (cf. FIG. 4 or 6). Because the bimetal element 1 is heated at low temperatures like only circa 60° C. to 80° C. during the trip event, the speed of the stabilization after the trip is much bigger than a nominal operation at 150° C. In addition, after the trip, the snap action device 20 and especially the spring element 3 have to move in the initial position in order to be available during a new trip event occurs. Therefore, the tripping device 2 has to move back like shown in FIG. 6, in which a side view of a reset view of the embodiment of the switching device 30 shown in FIGS. 4 and 5 is shown. With the dotted lines, the trip position of the spring element 3, especially of the spring winding 3.3, and of the bimetal element 1 is shown. Due to the movement of the tripping device 2 back in direction to the snap action device 20, a reset force is applied to the spring winding 3.3 in order to push the spring winding 3.3, thereby the spring winding 3.3 flips from the trip position to the initial position.

Figure 7:
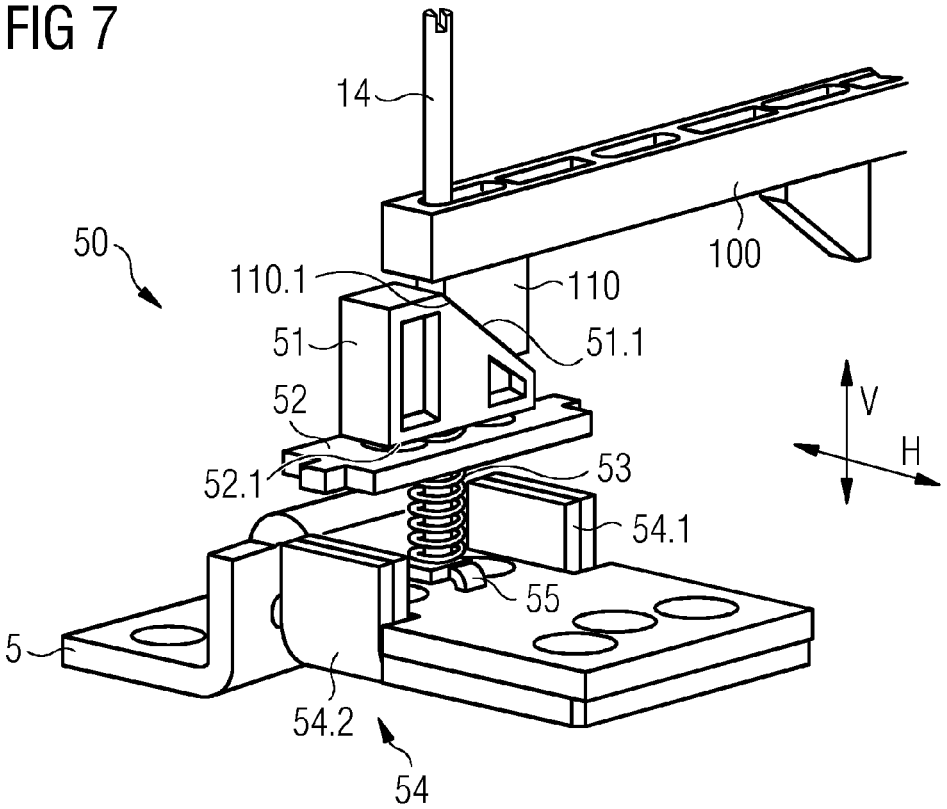
FIG. 7: a perspective view of an embodiment of a magnetic trip device of a thermal magnetic circuit breaker arranged on a current conductive element.

In FIG. 7 a perspective view of an embodiment of a magnetic trip device 50 arranged at a current conductive element 5 is shown. The current conductive element 5 contacts a yoke 54 and especially its upper layer 54.1 or first layer 54.1, respectively. Therefore, the current conductive element 5 extends through the yoke 54 and essentially between the legs of the yoke 54 along the yoke 54. An adjustment element 55, which is preferably designed like a calibration, is arranged between the current conductive element 5 and a spring element 53 in order to clamp the spring element 55 between the adjustment element 55 and an armature locator 51.

Advantageously, the spring element 55 is removable arranged at or fixed with the adjustment element 55. The spring element 55 extending between the adjustment element 55 and the armature locator 51 extends through the armature element 52 and especially through a bore 52.1 or a through-hole 52.1 of the armature element 52. The spring element 55 surrounds the pin 14 and especially the perimeter of the pin 14.

The pin 14 extends also through an adjustment bar 100, wherein the lower part of the pin 14 has a not shown threaded portion and especially an external thread, which is moveably engaged with a not shown internal thread of the adjustment element 55 and/or with a not shown internal thread of the current conductive element 5.

Basing on the movement of the armature element 52 in direction to the yoke 54 during a trip event, the armature locator 51 is moved in vertical direction V along the pin 14. Basing on this movement, the tripping device 2 (cf. FIG. 4 to 6 for example) is pushed to its final position, where the energy storage is released.

When the adjustment bar 100 is moved in a horizontal direction H, for example in direction to the armature locator 51 (leftwards), the armature locator 51 is moved downwards in direction to the yoke 54 and therefore in vertical direction V. Basing on this movement, the distance between the armature element 52 and the yoke 54 is reduced. The transformation of the horizontal movement of the adjustment bar 100 into a vertical movement of the armature locator 51 is done by means of both, the inclined area 110.1 or inclined surface 110.1, respectively, of the protrusion 110 of the adjustment bar 100 and the inclined area 51.1 or inclined surface 51.1, respectively, of the armature locator 51. Both, inclined area 110.1 and inclined area 51.1 contact each other and are movably arranged to each other in such a way that the inclined areas 110.1 and 51.1 slide against each other. Therefore, during a horizontal movement of the adjustment bar 100 in direction away from the armature locator 51 (rightwards), the armature locator 51 is moved in vertical direction V away from the yoke 54 (upwards) due to the spring load of the spring element 55. That means that the spring element 55 pushes back the armature locator 51. The adjustment bar 100 is only shown in sections in FIG. 7 and has preferably more than one protrusion 110 and especially two or three protrusions 110 in order to contact two or three single magnetic trip devices 50, for example as a three pole arrangement.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a tangible computer readable medium and is adapted to perform any one of the aforementioned methods when run on a computer device (a device including a processor). Thus, the tangible storage medium or tangible computer readable medium, is adapted to store information and is adapted to interact with a data processing facility or computer device to execute the program of any of the above mentioned embodiments and/or to perform the method of any of the above mentioned embodiments.

The tangible computer readable medium or tangible storage medium may be a built-in medium installed inside a computer device main body or a removable tangible medium arranged so that it can be separated from the computer device main body. Examples of the built-in tangible medium include, but are not limited to, rewriteable non-volatile memories, such as ROMs and flash memories, and hard disks. Examples of the removable tangible medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

REFERENCE SIGN LIST

1 bimetal element
1.1 first end/lower end of the bimetal element
1.2 second en/upper end of the bimetal element
2 tripping device
2.1 pivot axis
3 spring element/flat spring
3.1 first holder end area of the spring element
3.2 second holder end area of the spring element
3.3 spring winding
4 housing element
4.1 first clamp element
4.2 second clamp element
5 current conductive element
6 heater element
7 actuator element
7.1 fixing part
7.2 connecting part
10 thermal trip device
14 pin
20 snap action device
30 switching device

50 magnetic trip device
51 armature locator
51.1 inclined surface of the armature locator
52 armature element
52.1 through-hole of the armature
53 spring element of the magnetic trip device/compression spring
54 yoke
54. first layer of the yoke
54.2 second layer of the yoke
55 adjustment element
100 adjustment bar
110 protrusion
110.1 inclined surface of the protrusion
f minimal force
F big force
H horizontal direction
L longitudinal axis
Pi initial position
Pt trip position
V vertical direction

What is claimed is:

1. Thermal trip device of a thermal magnet circuit breaker for protecting an electrical circuit from damage by overload, the thermal trip device comprising:

at least one bimetal element, arranged with a first end of the at least one bimetal element at a current conductive element, for conducting electrical current, and arranged with a second end of the at least one bimetal element next to a tripping device, adapted for interrupting a current flow; and a snap action device for force transmission from the at least one bimetal element to the tripping device, wherein the snap action device includes a spring element attached at its ends to a stationary housing element, and wherein the bimetal element includes an actuator element, on the second end of the bimetal element, the actuator directly contacting the spring element at least during an overload occurs.

2. Thermal trip device of claim 1, wherein the spring element is a flat spring preloaded in a curved manner.

3. Thermal trip device of claim 2, wherein, in an initial position of the snap action device, a curve of the spring element is bended in direction to the bimetal element and in a trip position of the snap action device, the curve of the spring element is bended in direction to the tripping device.

4. Thermal trip device of claim 1, wherein, in an initial position of the snap action device, a curve of the spring element is bended in direction to the bimetal element and in a trip position of the snap action device, the curve of the spring element is bended in direction to the tripping device.

5. Switching device for interrupting a current flow, the switching device comprising:

at least a current conductive element for conducting electrical current;

a tripping device, adapted to interrupt the current flow;

a bimetal element, arranged with a first end of the bimetal element at the current conductive element, and arranged with a second end of the bimetal element next to at least one of the tripping device; and a snap action device, arranged between the tripping device and the bimetal element, to transmit force of the bimetal element to the tripping device at least during a trip event, wherein the snap action device includes a spring element attached at its ends to a stationary housing element, and wherein the bimetal element includes an actuator element, on the second end of the bimetal element, the actuator directly contacting the spring element at least during an overload occurs.

6. Switching device of claim 5, further comprising a thermal trip device of a thermal magnet circuit breaker for protecting an electrical circuit from damage by overload.

7. Thermal magnetic circuit breaker for protecting an electrical circuit from damage caused by overload or short circuit, comprising:

at least one of the switching device of claim 6.

8. Thermal magnetic circuit breaker for protecting an electrical circuit from damage caused by overload or short circuit, comprising:

at least one of the switching device of claim 5.

9. Method for protecting an electric circuit from damage by overload by way of a thermal trip device of a thermal magnet circuit breaker, the method comprising:

heating, via an electric current conducted at least partially along a current conductive element, a bimetal element, having an actuator on a free end of the bimetal, arranged with a first end of the bimetal element at the current conductive element, at least indirectly, during an overload occurrence; and deflecting, based on the heating, the bimetal element and the actuator in direction to a tripping device; and transmitting, via a stationary snap action device arranged in a housing between the bimetal element and the tripping device, a force of the deflecting bimetal element to the tripping device to move the tripping device to interrupt the current flow by causing the actuator to directly contact the snap action device at least during an overload.

10. The method of claim 9, wherein a portion of a spring element of the snap action device moves from an initial position to a trip position in order to unlatch the tripping device during an overload occurrence.

11. The method of claim 10, wherein the spring element is a flat spring.

* * * * *